US011407482B2

(12) United States Patent
Bernocchi

(10) Patent No.: US 11,407,482 B2
(45) Date of Patent: Aug. 9, 2022

(54) FURLING AND ADJUSTMENT ASSEMBLY FOR BOAT SAILS

(71) Applicants: Matteo Sergio Bernocchi, Busto Arsizio (IT); Enzo Bernocchi, Busto Arsizio (IT)

(72) Inventor: Enzo Bernocchi, Busto Arsizio (IT)

(73) Assignees: Matteo Sergio Bernocchi, Busto Arsizio (IT); Enzo Bernocchi, Busto Arsizio (IT)

( * ) Notice: Subject to any disclaimer, the term of this patent is extended or adjusted under 35 U.S.C. 154(b) by 0 days.

(21) Appl. No.: 17/289,935

(22) PCT Filed: Oct. 28, 2019

(86) PCT No.: PCT/EP2019/079372
§ 371 (c)(1),
(2) Date: Apr. 29, 2021

(87) PCT Pub. No.: WO2020/089159
PCT Pub. Date: May 7, 2020

(65) Prior Publication Data

US 2022/0009610 A1 Jan. 13, 2022

(30) Foreign Application Priority Data

Oct. 29, 2018 (IT) ..... 102018000009855

(51) Int. Cl.
*B63H 9/10* (2006.01)
*B63B 15/00* (2006.01)

(52) U.S. Cl.
CPC ..... *B63H 9/1021* (2013.01); *B63B 15/00* (2013.01); *B63B 2015/0008* (2013.01); *B63H 2009/1057* (2013.01)

(58) Field of Classification Search
CPC .. B63H 9/1021; B63H 9/1028; B63H 9/1035; B63H 9/1042; B63H 2009/105; B63H 2009/1057; B63H 2009/1064
See application file for complete search history.

(56) References Cited

U.S. PATENT DOCUMENTS 3,958,523 A * 5/1976 Holmes ..... B63H 9/1028 114/106
4,034,694 A * 7/1977 Dismukes ..... B63H 9/1028 114/106

(Continued)

FOREIGN PATENT DOCUMENTS

DE 19535890 A1 4/1997
FR 2794100 A1 12/2000
WO WO-2005118388 A1 * 12/2005 ..... B63H 9/1028

OTHER PUBLICATIONS

International Search Report dated Dec. 5, 2019 re: Application No. PCT/EP2019/079372, pp. 1-3, citing: US 2015/0210372 A1, FR 2 794 100 A1 and DE 195 35 890 A1.

(Continued)

*Primary Examiner* — Andrew Polay
(74) *Attorney, Agent, or Firm* — Cantor Colburn LLP

(57) ABSTRACT

A furling and adjustment assembly for boat sails, includes a hooking device, configured to be mated to a coupling for the sail and to a tack sheet. The assembly also includes an actuation pulley assembly, configured to be actuated by an actuation rope and functionally associated with the hooking device in order to transmit, by way of the latter, a furling/unfurling movement to the sail. The hooking device and the actuation pulley assembly can be mutually moved between a condition of mutual engagement and a condition of mutual disengagement, so as to allow the adjustment of the tack point of the sail (Continued)

while a fixed spatial position of the actuation pulley assembly remains constant.

10 Claims, 7 Drawing Sheets

(56) References Cited

U.S. PATENT DOCUMENTS

| | | | | |
|---|---|---|---|---|
| 2005/0211149 | A1* | 9/2005 | Greghi | B63H 9/1028 114/104 |
| 2015/0210372 | A1* | 7/2015 | Hartlmeier | D07B 1/0673 114/105 |

OTHER PUBLICATIONS

Written Opinion dated Dec. 5, 2019 re: Application No. PCT/EP2019/079372, pp. 1-5, citing: US 2015/0210372 A1.

* cited by examiner

FURLING AND ADJUSTMENT ASSEMBLY FOR BOAT SAILS

TECHNICAL FIELD

The present disclosure relates to a furling and adjustment assembly for boat sails, in particular for free stay sails of sailboats; a further object of the disclosure is a boat provided with such assembly.

BACKGROUND

Free stay sails (e.g. sails of the Code 0 or gennaker type) of a sailing boat are usually provided with an anti-torsion cable, which is useful for furling the sails on themselves when not in use.

To this end furler devices have been developed, and are known in the state of the art, which comprise a rotating disk-like body which is connected to the tack point of the sail; the disk-like body is actuated in rotation by way of a sheet, which in turn is actuated manually or using actuators (e.g. electric motors). This solution makes the steps of furling/unfurling the sail faster, but it does not allow any adjustment of the tension of the luff, since the disk-like body is integral with the tack point.

More advanced furling and adjustment assemblies were therefore developed, which are adapted to allow, in addition to the furling of the sail, also an adjustment of the tension of the luff, with the consequence of varying the shape that the sail assumes; in these advanced conventional solutions, the adjustment occurs by making it possible to shift the entire disk-like body with respect to its fixing point: although this solution is capable of allowing a certain amount of adjustment of the tension of the luff, it has not been found to be completely satisfactory, because of the fact that the maneuvering radius is limited overall and because of the fact that the disk-like body has a certain weight and a certain space occupation, ultimately entailing a certain difficulty of maneuvering.

SUMMARY

The present disclosure provides a furling and adjustment assembly for sails, as well as a boat equipped therewith, which is capable of improving the known art in one or more of the above mentioned aspects.

Within this aim, the disclosure provides a furling and adjustment assembly, as well as a boat equipped therewith, which allows an adjustment of the tension of the luff, whose rigging is simplified.

The disclosure also provides a furling and adjustment assembly, as well as a boat equipped therewith, which allows a large-scale adjustment of the tack point.

The disclosure provides a furling and adjustment assembly, as well as a boat equipped therewith, which makes it possible to take optimal advantage of the characteristics of the sail.

The disclosure further provides a furling and adjustment assembly, as well as a boat equipped therewith, which makes it possible to improve the handling and the stability of the boat on which it is mounted.

Furthermore, the present disclosure overcomes the drawbacks of the known art in an alternative manner to any existing solutions.

The disclosure provides a furling and adjustment assembly for sails that is highly reliable, easy to implement and of low cost.

This aim and these and other advantages which will become better apparent hereinafter are achieved by providing a furling and adjustment assembly for sails according to claim 1, optionally provided with one or more of the characteristics of the dependent claims.

BRIEF DESCRIPTION OF THE DRAWINGS

Further characteristics and advantages of the disclosure will become better apparent from the detailed description that follows of a preferred, but not exclusive, embodiment of the furler device for sails according to the disclosure, which is illustrated for the purposes of non-limiting example in the accompanying drawings wherein.

DETAILED DESCRIPTION OF THE DRAWINGS

Figure 1:
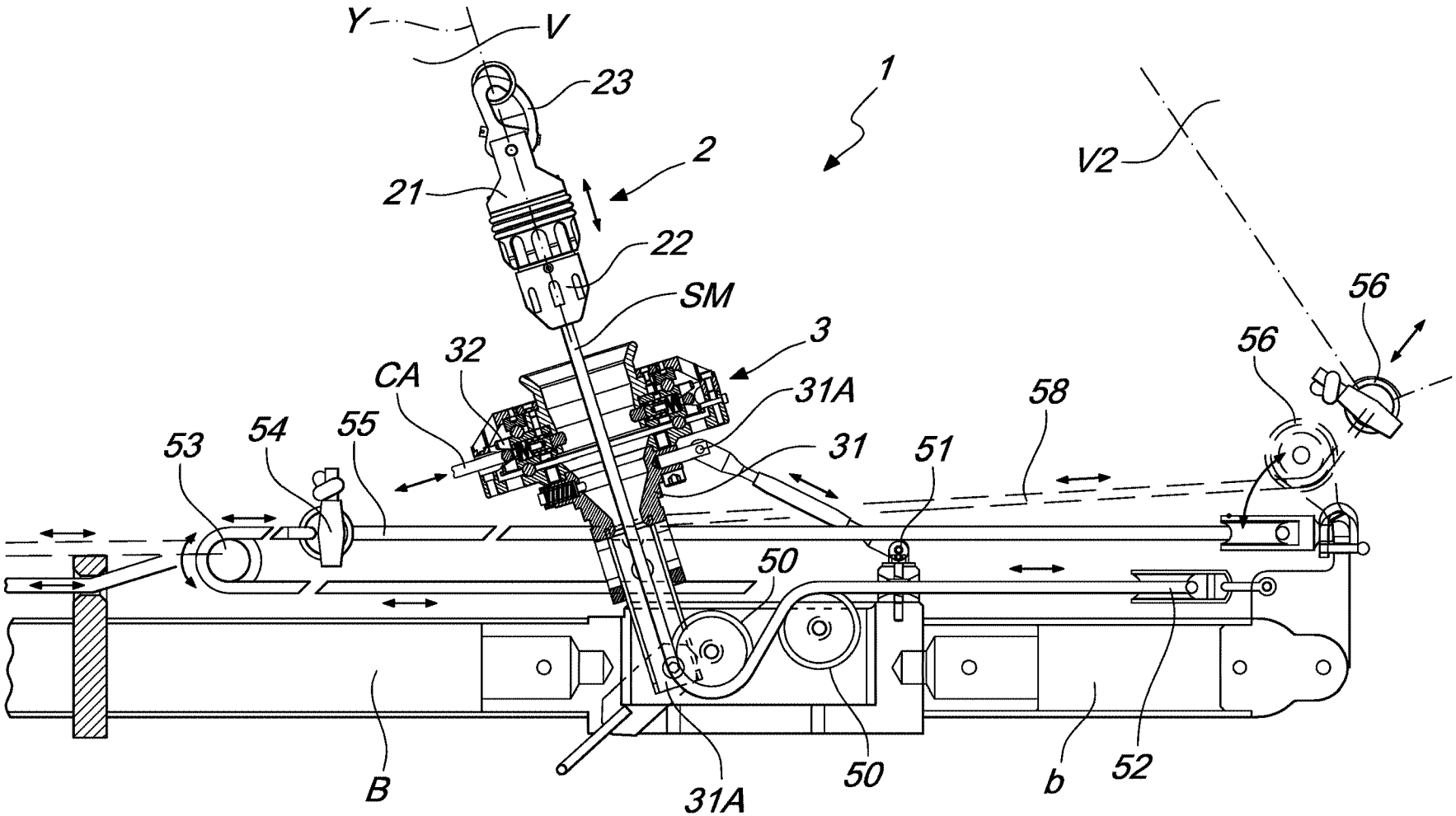
FIG. 1 is a cross-sectional side view of the furling and adjustment assembly for boat sails according to the disclosure, in the installed condition.

With reference to the figures, the furling and adjustment assembly for boat sails, according to the disclosure, generally designated by the reference numeral 1, is shown overall in FIG. 1.

Generally, it comprises a hooking device 2, which is configured to be mated to a coupling 23 for the sail V and to a tack sheet SM.

In brief, it should be noted from this point onward that the tension of the luff is adjusted using the tack sheet SM, in short, by moving the lower point of attachment of the sail.

The sails to which the present disclosure applies are free stay sails, used at the bow of the boat, i.e. sails fitted with an anti-torsion cable; such sails, when not in use, are furled upon themselves around the anti-torsion cable.

More preferably, the present disclosure applies to sails of the Code 0 or gennaker type.

The furling and adjustment assembly 1 also comprises an actuation pulley assembly 3, configured to be actuated by an actuation rope CA and functionally associated with the hooking device 2 in order to transmit, by way of the latter, a furling/unfurling movement to the sail V.

According to the present disclosure, the hooking device 2 and the actuation pulley assembly 3 can be mutually moved between a condition of mutual engagement and a condition of mutual disengagement, so as to allow the adjustment of the tack point of the sail while a fixed spatial position of the actuation pulley assembly 3 remains constant.

Figure 5:
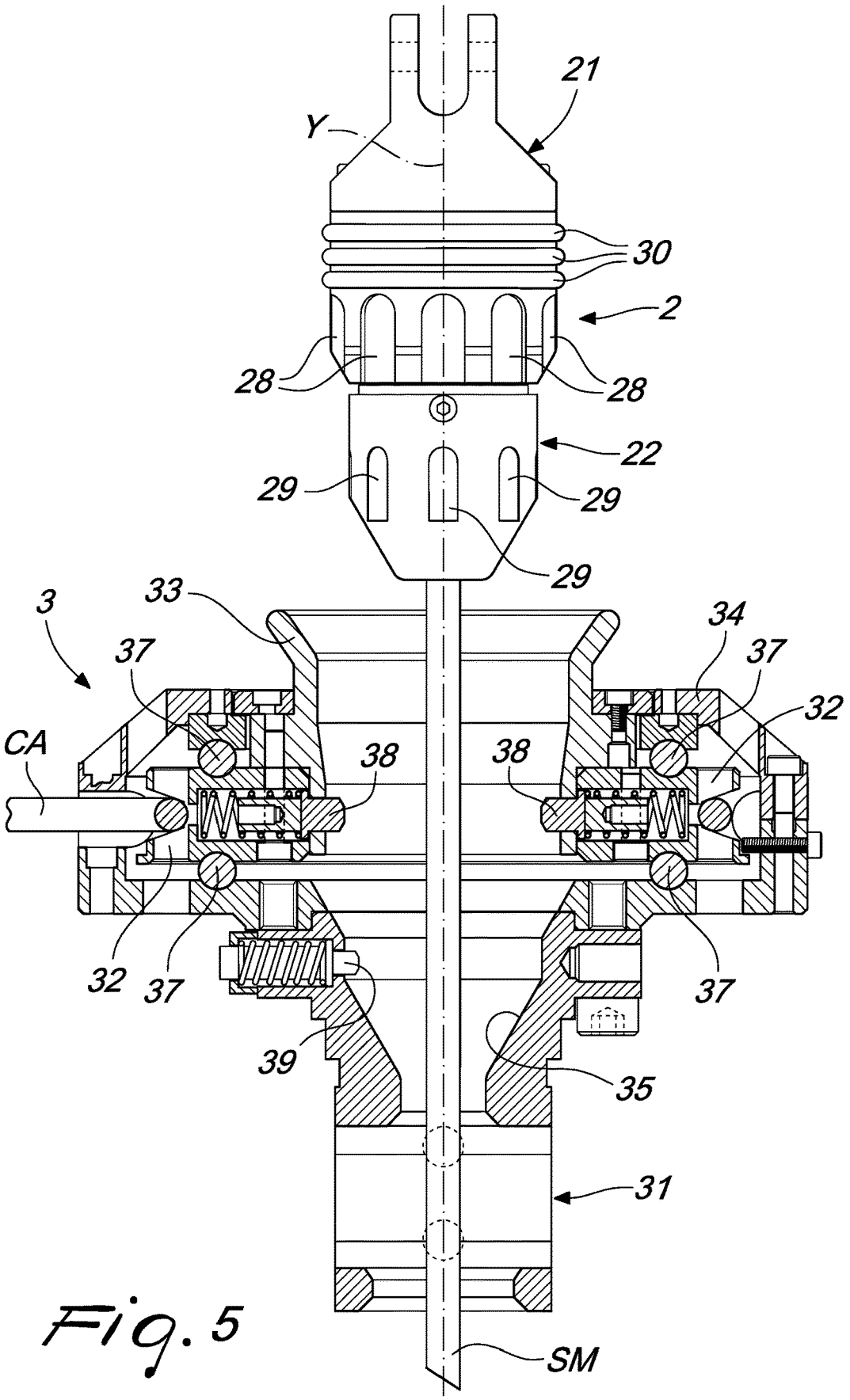
FIGS. 5 and 6 are cross-sectional side views of the assembly in the previous figures, respectively in a condition of mutual disengagement between the hooking device and the pulley assembly and a condition of engagement between the hooking device and the pulley assembly.
Figure 6:
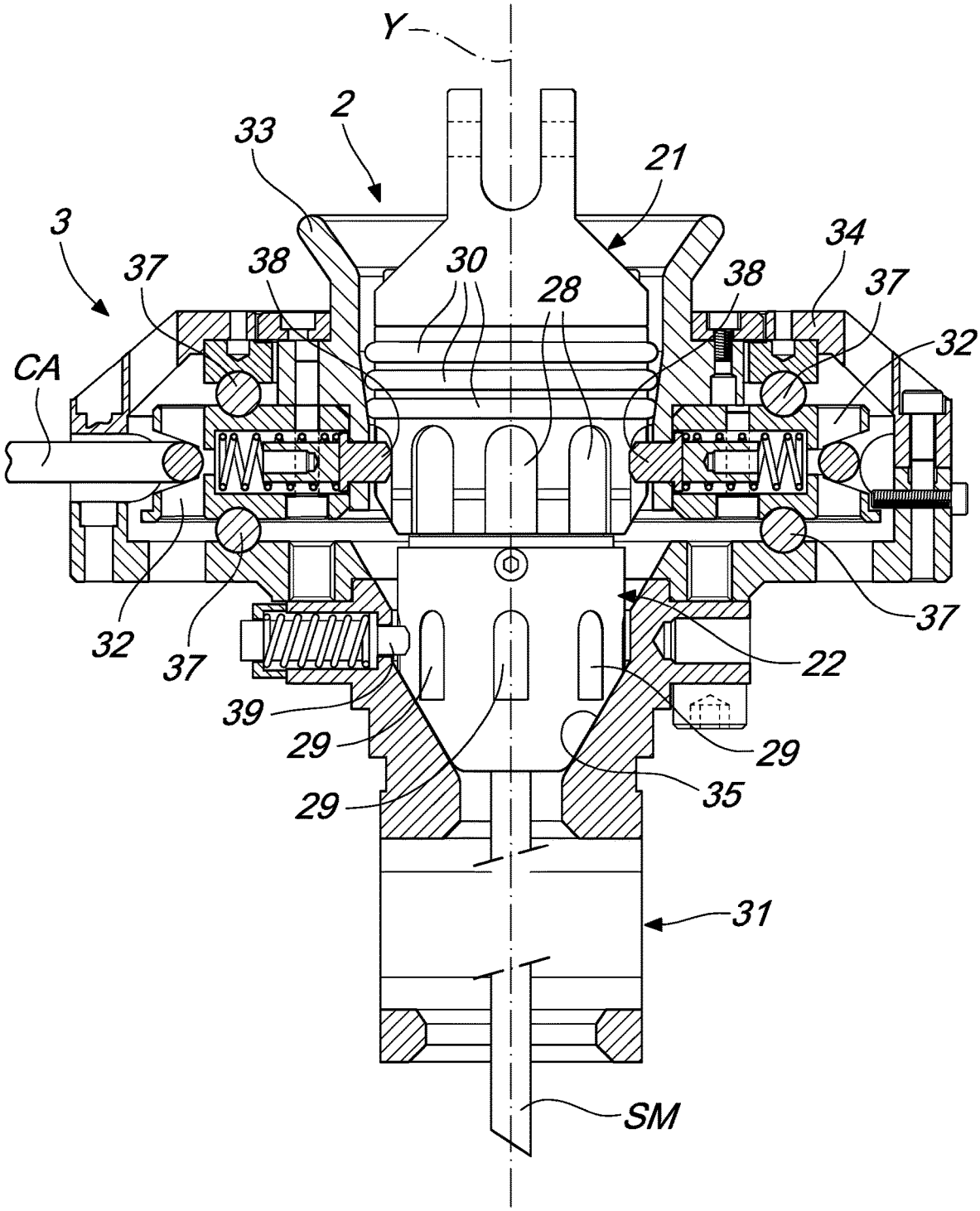

In particular, the condition of mutual engagement is shown in FIG. 6 while the condition of mutual disengagement is shown in FIG. 5 (or in FIG. 1).

In this manner, the tack point of the sail can be adjusted without it being necessary to shift the entire pulley assembly, which can remain stationary in position with respect to the bridge of the boat, thus solving the problems described above.

Figure 2:
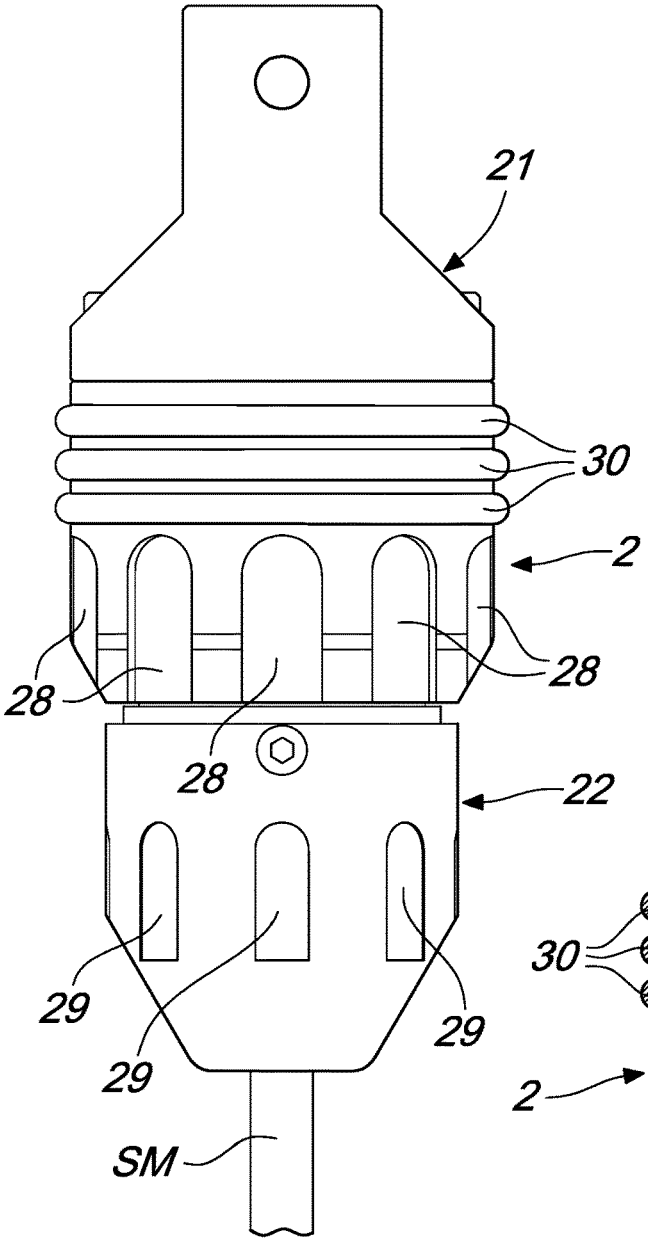
FIGS. 2 and 3 are respectively a side view and a cross-sectional view of a hooking device of the assembly in the previous figure.
Figure 3:
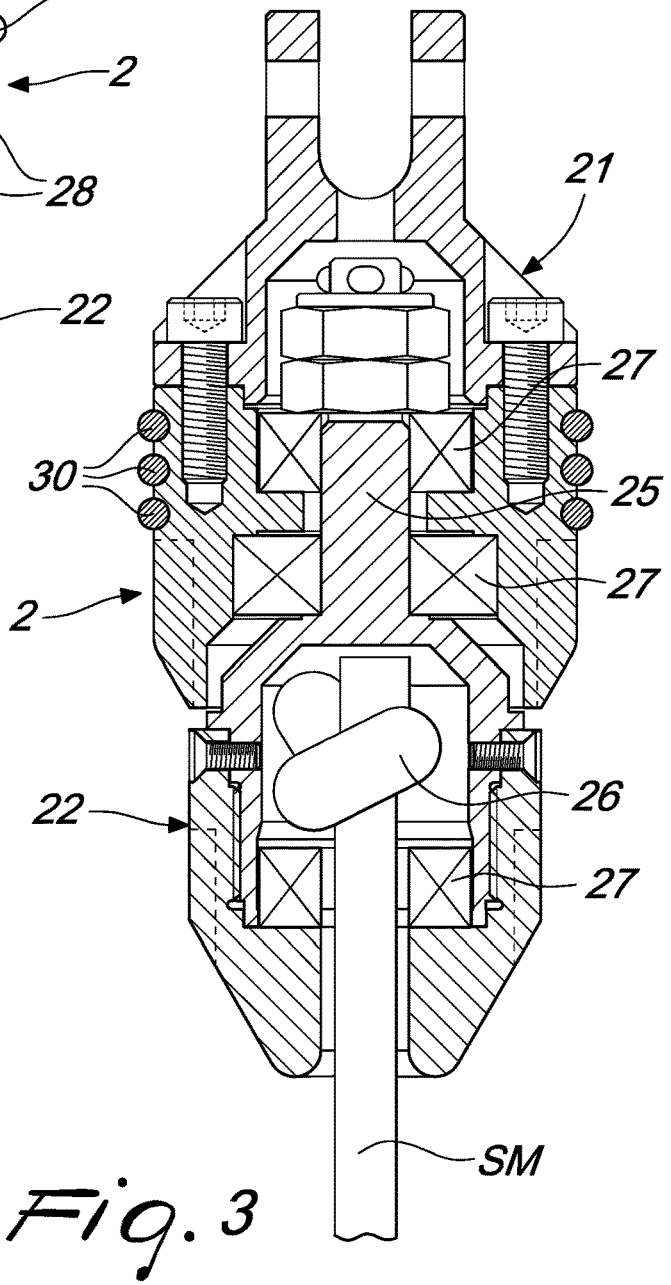

Descending into more detail and with reference to FIGS. 2 and 3, according to an optional and advantageous characteristic of the disclosure, the hooking device 2 in turn comprises an upper hooking element 21 and a lower hooking element 22.

The upper hooking element 21 is configured to be mated to a coupling 23 for the sail V, while the lower hooking element 22 is configured to be mated to the tack sheet SM, which, tautened or slackened, determines the tack point.

Note that advantageously the upper hooking element 21 and the lower hooking element 22 are mutually coupled so as to form an idle rotary pair: in substance the upper hooking element 21 and the lower hooking element 22 are free to rotate with respect to each other. This prevents any rotations of the former 21 (which occur for example in the rigging for furling or unfurling the sail) from being transmitted to the tack sheet SM, which would cause an unwanted torsion therein.

Discussing in more detail, and with reference to FIGS. 2 and 3, the lower hooking element 22 comprises an internal cable stop 26 which locks (in a manner known per se) the tack sheet SM, while the upper hooking element 21 comprises a U-shaped upper end, perforated, in which the coupling 23, for example a spring-clip or the like, can be engaged.

The upper hooking element 21 and the lower hooking element 22 are preferably connected by way of a common inner shaft 25 on which anti-friction bearings 27 are mounted.

Optionally the upper element 21 has a frustum-shaped upper end (directed toward the sail V in the mounted condition), while the lower element 22 has a frustum-shaped lower end, the purpose of which will shortly become clear.

Each upper hooking element and lower hooking element, respectively 21 and 22, comprises first engagement devices, respectively 28 and 29, preferably radial grooves.

Preferably the upper element 21 also has outer wear-resistant rings 30 (such as O-rings or the like) at a substantially cylindrical section thereof, the purpose of which will shortly be made clear.

Figure 4:
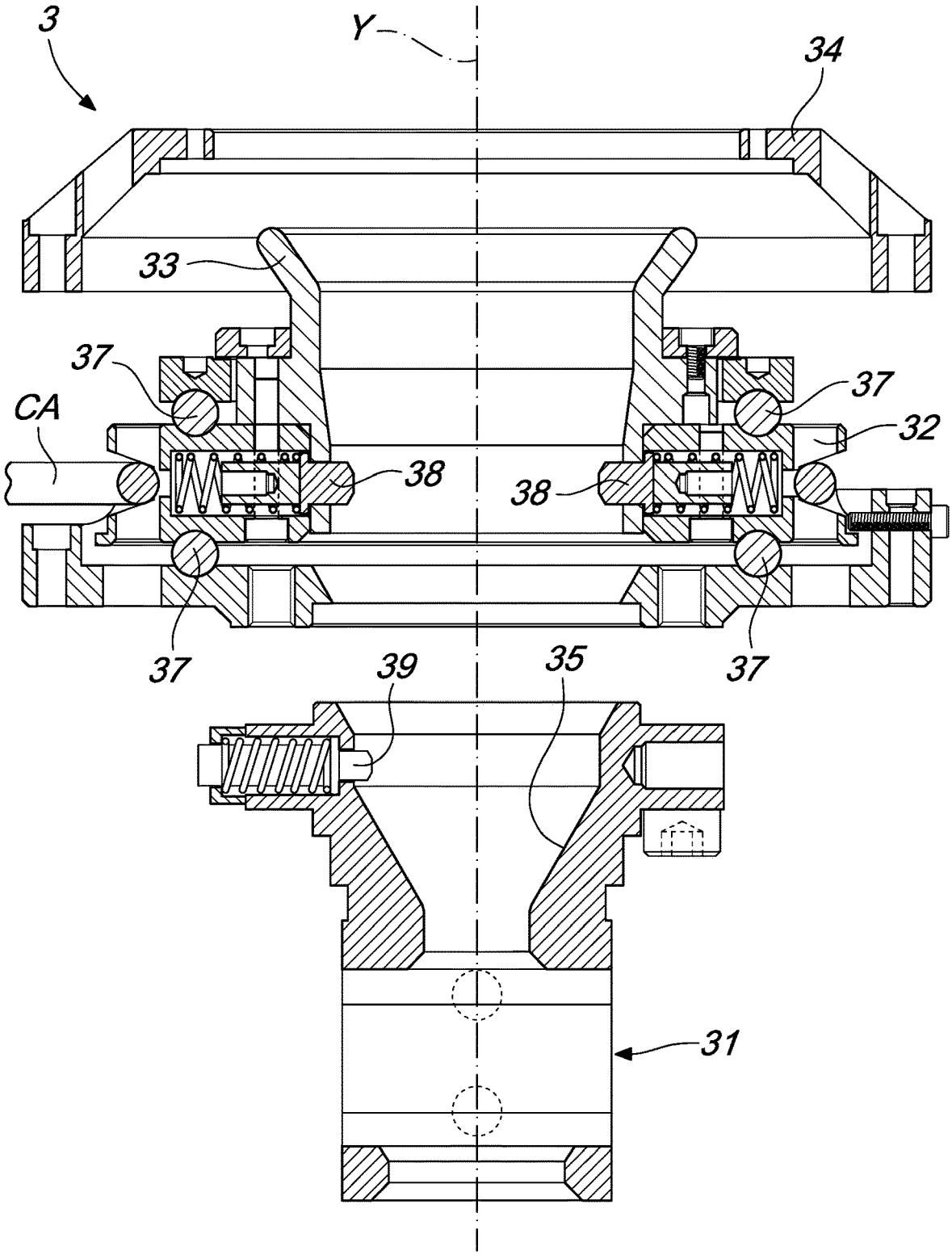
FIG. 4 is a cross-sectional exploded side view of the actuation pulley assembly of the furling assembly in FIG. 1.

Turning now to the actuation pulley assembly 3, in the preferred embodiment shown in FIG. 4, this in a basic form comprises at least one fixing body 31 and an ordinary pulley 32.

The fixing body 31 is provided with fixing portions 31A (visible in FIG. 1) which are configured to be fixed to the boat; for example, in the preferred embodiment shown, it comprises two fixing portions 31A with holes in which adjustable rigid stays are engaged for coupling to the boat; obviously, as an alternative, different solutions for coupling can be envisaged, but all are to be considered equivalent for the purposes of the present disclosure.

The pulley 32 is coupled rotatably to the fixing body 31, so as to be able to rotate when actuated by the actuation rope CA which is wound partially on the pulley 32, preferably making a loop rope.

Before going into further detail, it is advantageous to note the preferred positioning of the furling and adjustment assembly 1 in the context of the boat, shown in FIG. 1, which, according to the disclosure, is fixed to the bow between the bowsprit B and the jib boom b, to which it is fixed integrally with the fixing body 31 by way of the fixing portions 31A.

The fixing body 31 and the pulley 32 comprise second engagement devices, respectively 38 and 39, preferably in the form of radial pins of shape and dimensions that are compatible with their insertion into the radial grooves 28 and 29 of the upper and lower coupling elements 21, 22 which are described above.

In the preferred embodiment, the condition of mutual engagement between the hooking device 2 and the actuation pulley assembly 3 is in fact achieved by way of the first engagement devices 28, 29 and the second engagement devices 38, 39, as shown in FIG. 6.

Particularly, in this condition of mutual engagement, the first engagement devices 28 of the upper hooking element 21 are designed to be mated to the second engagement devices 38 of the pulley 32, so as to determine an at least rotating coupling between the upper hooking element 21 and the pulley 32. Therefore, in the condition of mutual engagement, the upper hooking element 21 is integral in rotary movement with the pulley 32, so that actuation of the latter by way of the actuation rope CA entails a corresponding rotation of the upper hooking element 21 and therefore, ultimately, of the sail V.

Similarly, when in the condition of mutual engagement, the first engagement devices 29 of the lower hooking element 22 are mated to the second engagement devices 39 of the fixing body 31, in order to determine a locking in place between the lower hooking element 22 and the fixing body 31. Therefore, in the condition of mutual engagement in FIG. 6, the lower hooking element 22 is integral with the fixing body 31, which in turn is fixed because it is coupled to the hull (or to the bowsprit/jib boom) by way of the fixing portions with holes with which it is provided.

The holding of the condition of mutual engagement is ensured by the tack sheet SM, which is tautened, as will shortly be described.

Since the upper hooking element 21 and the lower hooking element 22 can freely rotate with respect to each other, the result is that in the position of mutual engagement between the hooking device 2 and the actuation pulley assembly 3 the rotation of the upper hooking element 21 is caused by the actuation rope CA which acts on the pulley 32, while the lower hooking element 22 is fixed and stationary with respect to the hull, held in that position by way of the fixing body 31 with which it is integral.

Therefore, in the condition of mutual engagement, the actuation rope CA is capable of making the corner of the sail V connected to the upper element 21 rotate, without generating torsions in the tack sheet SM.

The stability of the condition of mutual engagement is ensured by the traction of the tack sheet SM, which, by acting on the lower element 22, holds it in the coupling configuration with the pulley assembly 3 by virtue of the first engagement devices 28, 29 and the second engagement devices 38, 39.

Preferably in the condition of mutual engagement, the lower element 22 is entirely accommodated in the fixing body 31, within a lower cup-shaped body 35, which is described below.

In the condition of disengagement, in FIG. 5, on the other hand, the hooking device 2 is remote (in this case, extracted) with respect to the actuation pulley assembly 3, so that the first and the second engagement devices (e.g. teeth and grooves) are not in mutual engagement.

In this condition of mutual disengagement, the furling assembly 1 (particularly, the pulley 32) is not capable of transmitting any rotation to the sail V, because the two elements, upper 21 and lower 22, are free to rotate with respect to each other; in this condition, therefore, no torsion movement is transferred from the sail V to the tack sheet SM, thus preventing an early deterioration thereof. In this condition, however, actuating the tack sheet SM (by applying or removing a control force on it) entails a displacement of the tack point of the sail V, determined by the displacement (distancing or approaching) of the hooking device 2 from/to the pulley assembly 3.

When it is necessary to pass from the condition of mutual engagement to the condition of mutual disengagement, it is sufficient to release the tack sheet SM: the force of the sail tends in fact to extract the hooking device 2 from the pulley assembly 3, releasing the mutual engagement between the first engagement devices 28, 29 and the second engagement devices 38, 39.

This is ensured by the fact that the first engagement devices (i.e. the grooves) 28, 29 are preferably provided as downwardly-open arcs: in this manner they do not obstruct the extraction of the pins 38, 39 caused by the axial movement along Y of the hooking device 2, which occurs when the tack sheet SM is released.

At the same time this configuration of the grooves 28, 29, with the top of the arc directed toward the sail, ensures a stable arrest point: when in fact the pins 38, 39 are seated in the grooves 28, 29 and the tack sheet SM is tautened, the pins slide in the grooves until they reach their upper crests, where the grooves 28, 29 are closed, therefore stopping in a stable position, which is held until such time as the tack sheet SM exerts the traction force.

Returning to the preferred embodiment shown, note that, although in this embodiment the first engagement devices are radial grooves 28, 29 and the second engagement devices 38, 39 are extractable radial pins, in an entirely equivalent manner, the pins and the grooves can be mutually inverted.

The pins 38, 39 are preferably provided with an elastic element, e.g. a spring, in order to be arranged stably in the extracted condition from their seat, i.e. in a condition of possible engagement with the grooves 28, 29.

Returning now to describe the pulley assembly 3, this comprises an outer casing 34 which is centrally perforated and accommodates the pulley 32; the outer casing 34 is fixed integrally in the manner of a lid to a widened upper end of the fixing body 31.

The casing 34 is therefore stationary with respect to the fixing body 31 and with respect to the pulley 32.

The pulley is mounted so that it can rotate with respect to the casing 34 and to the body 31 by virtue of one or more ball circulation tracks 37 or, equivalently, by virtue of rolling bearings or similar contrivances.

The pulley assembly 3 also comprises an upper cup-shaped body 33 and a lower cup-shaped body 35.

The upper cup-shaped body 33 is integral with the pulley 32 (and therefore rotatable) and protrudes upward from the outer casing 34.

The upper cup-shaped body 33 is provided with an axial through opening which is concentric with the rotation axis Y of the pulley and the rotation axis of the hole of the casing 34, the hooking device 2 being inserted into such opening when it is brought to the condition of mutual engagement with the pulley assembly 3.

Preferably the portion of the upper cup-shaped body 33 that protrudes outside the casing 34 provides an upper inlet, which is frustum-shaped (or has conical walls) so as to facilitate the insertion of the hooking device 2 during maneuvers.

To this end, in a similar manner, the lower hooking element 22 has a conical or frustum-shaped lower end, described previously, so as to slide without obstructions on the portion of frustum-shaped inlet of the upper cup-shaped body 33 during coupling.

In the condition of mutual engagement, in FIG. 6, the wear-resistant rings 30 prevent the early wear of the upper cup-shaped body 33 and/or of the upper hooking element 21, by preventing contact between them when the second rotates with respect to the first.

Turning now to the lower cup-shaped body 35, this is integral with the fixing body 31, and preferably provided in it.

The shape and the dimensions of the conical or frustum-shaped cavity defined by the lower cup-shaped body 35 are preferably such as to accommodate the lower hooking element 22 with precision, so as to achieve a precise locking in place thereof in the condition of mutual engagement.

The lower cup-shaped body 35 is open at the two ends: in an upward region in order to allow the insertion of the lower hooking element 22 and in a downward region in order to allow the passage of the tack sheet SM, which needs to be connected to the lower hooking element 22.

A further object of the disclosure is a boat that comprises a free stay sail and a furling and adjustment assembly 1 for sails of the type just described.

With reference to FIG. 1, preferably the fixing body 31 comprises transmission pulleys 50 for the tack sheet SM, and the boat comprises a fairlead 51 fixed on the jib boom b and a tackle block 52 on the yardarm of the jib boom b, through which the tack sheet SM passes, turned around through 180°, before arriving at a rigging pulley 53 which is fixed on the deck of the boat and then being redirected to the rapid hooking/unhooking coupling 54 which is connected to the running rigging 55 connected to the tackle block 56 which redirects to a stopper located on the bridge.

In this way it is possible, on a boat of the type just described, to trim a sail V2 for a broad reach and with a stern wind, for example a standard (non-furlable) gennaker, to the yardarm of the jib boom b by way of the rigging 58 connected to the movable and orientable tackle block 56.

Therefore by way of the rigging 58 alone it is possible to use multiple bow sails with a single control from the cockpit of the boat.

Figure 7:
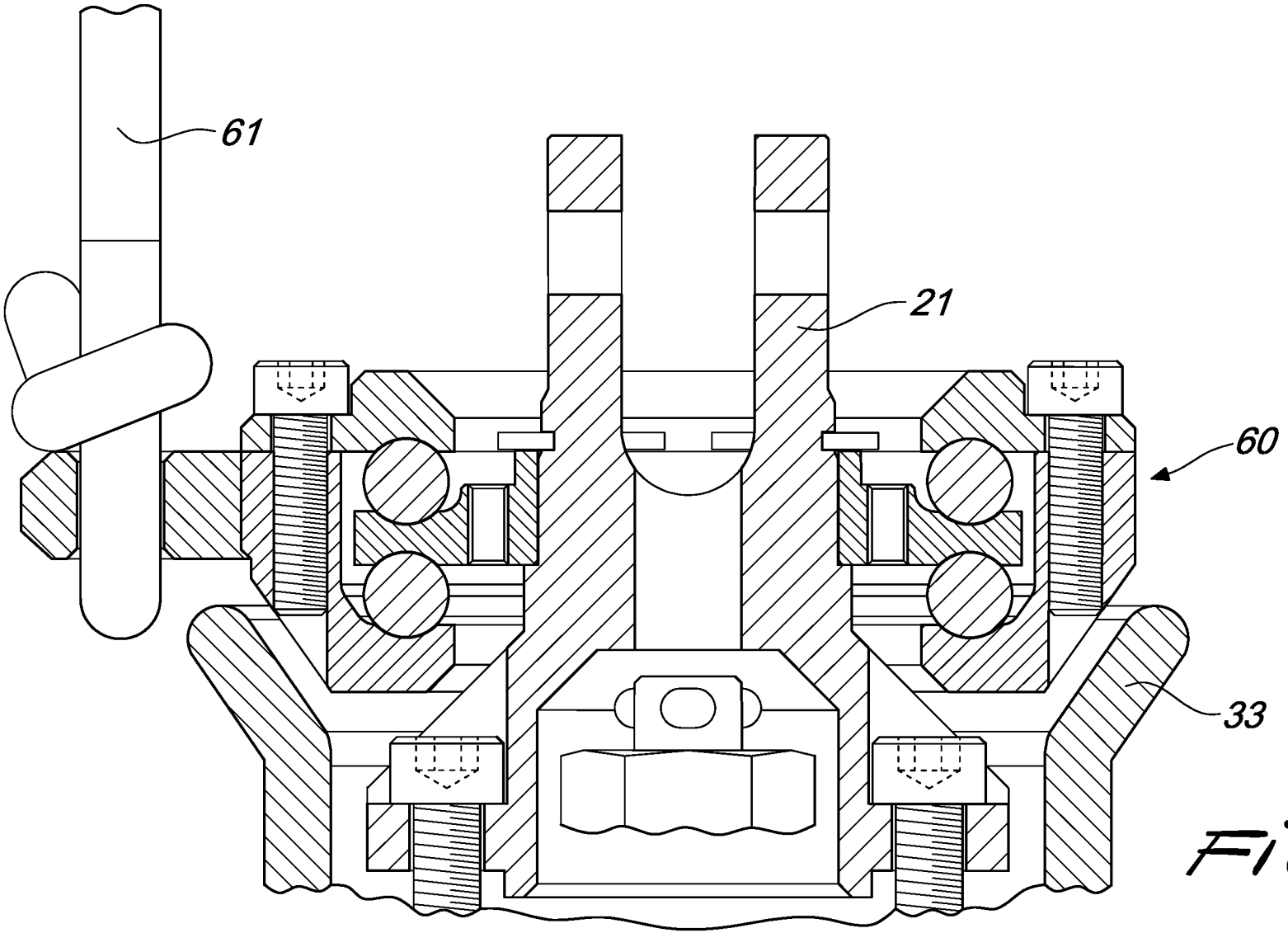
FIGS. 7 and 8 show an accessory suitable for use in combination with the furling and adjustment assembly according to the present disclosure.
Figure 8:
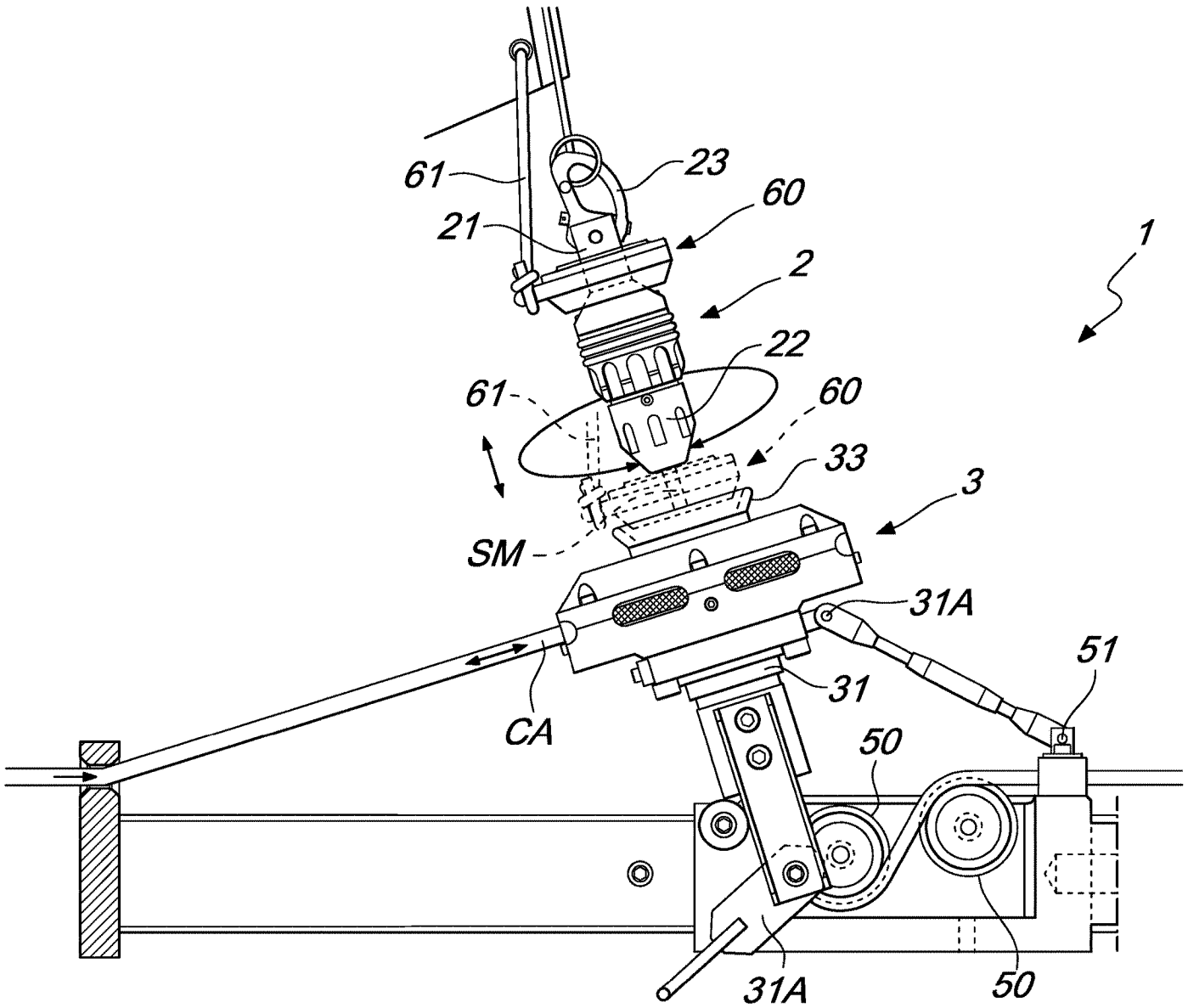

FIGS. 7 and 8 show an accessory adapted to be used with the furling and adjustment assembly according to the present disclosure. In particular, the accessory, designated by the reference numeral 60, is a tack fifth wheel which comprises a component to be installed on the hooking element 21 of the furling and adjustment assembly (FIG. 6), and which is used for furling sails like a gennaker/trioptimal/gen zero, etc, all asymmetric sails i.e. fuller sails for sailing close-hauled from the fore-and-aft beam to the stern.

Such sails are equipped with anti-torsion cable reeved in the luff.

By virtue of the tack fifth wheel 60, during rotation of the actuation pulley assembly 3 (FIG. 6) the tack point remains stationary (since it is idle).

The tack fifth wheel 60 is connected by way of a tack strop 61 to the tack of the sail.

During rotation the anti-torsion rope is twisted and then, after a short while, transmits the load thus twisted which, in turn, is translated to furling of the sail from head to tack.

In practice it has been found that the disclosure fully achieves the intended aim and objects by providing a furling and adjustment assembly in which the adjustment of the tack point of the sail is simple and easy.

In particular, the furling and adjustment assembly for sails, as well as the boat equipped with same, are capable of enabling an adjustment of the tension of the luff, the rigging of which is simplified.

In particular the furling and adjustment assembly for sails, as well as the boat equipped with same, are capable of enabling a large-scale adjustment of the tack point.

In particular the furling and adjustment assembly for sails, as well as the boat equipped with same, are capable of taking optimal advantage of the characteristics of the sail.

In particular, the furling and adjustment assembly for sails, as well as the boat equipped with same, are capable of improving the handling and the stability of the boat on which it is mounted.

In particular the furling and adjustment assembly for sails, as well as the boat equipped with same, represent an alternative to any existing solutions.

The disclosure, thus conceived, is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

The disclosures in Italian Patent Application No. 102018000009855 from which this application claims priority are incorporated herein by reference.

The invention claimed is:

1. A furling and adjustment assembly for boat sails, the assembly comprises:

a hooking device configured to be mated to a coupling for a sail and to a tack sheet, and an actuation pulley assembly configured to be actuated by an actuation rope and functionally associated with the hooking device in order to transmit, by way of said hooking device, a furling/unfurling movement to the sail, wherein the hooking device and the actuation pulley assembly are configured to be mutually moved between a condition of mutual engagement and a condition of mutual disengagement, so as to allow an adjustment of a tack point of the sail while a fixed spatial position of the actuation pulley assembly remains constant.

2. The furling and adjustment assembly for sails according to claim 1, wherein the hooking device in turn comprises an upper hooking element and a lower hooking element, which are mutually coupled to form an idle rotary pair, the upper hooking element being configured to be mated to a coupling for the sail, the lower hooking element being configured to be mated to a tack sheet for the adjustment of the tack point of the sail.

3. The furling and adjustment assembly for sails according to claim 2, wherein the actuation pulley assembly comprises a fixing body and a pulley, the fixing body being provided with fixing portions configured to be fixed to a boat, the pulley being rotatably coupled to a wider section of the fixing body.

4. The furling and adjustment assembly for sails according to claim 3, wherein each upper hooking element and lower hooking element comprises first engagement devices and wherein the fixing body and the pulley comprise corresponding second engagement devices, the first engagement devices of the upper hooking element being adapted to be mated to the second engagement devices of the pulley in said condition of mutual engagement, in order to determine a rotating coupling between the upper hooking element and the pulley, the first engagement devices of the lower hooking element being adapted to be mated to the second engagement devices of the fixing body in said condition of mutual engagement, in order to determine a fixed coupling between the lower hooking element and the fixing body.

5. The furling and adjustment assembly for sails according to claim 4, wherein the first engagement devices comprise a plurality of radial grooves provided on said upper hooking element and said lower hooking element and the second engagement devices comprise a plurality of extractable radial pins provided on the pulley and on the fixing body.

6. The furling and adjustment assembly for sails according to claim 5, wherein said plurality of radial grooves have an arc-like shape, with a lower opening for the extraction of said plurality of radial pins.

7. The furling and adjustment assembly for sails according to claim 3, wherein the pulley assembly comprises an outer casing which is centrally perforated and accommodates the pulley, said outer casing being fixed integrally in the manner of a lid to a widened upper end of the fixing body.

8. The furling and adjustment assembly for sails according to claim 3, wherein the pulley assembly comprises an upper cup-shaped body which is integral with the pulley and protrudes upward from the outer casing, said upper cup-shaped body having an axial through opening that is concentric with a rotation axis of the pulley and being configured to receive the hooking device when it is brought to said condition of mutual engagement with the pulley assembly, said upper cup-shaped body being further provided with an upper inlet with a frustum-like shape in order to facilitate an insertion of the hooking device.

9. The furling and adjustment assembly for sails according to claim 8, wherein the pulley assembly comprises a lower cup-shaped body which is aligned along the rotation axis of the pulley with the upper cup-shaped body and the outer casing, said upper cup-shaped body being integral with the fixing body, provided therein, and defining at least one conical or frustum-shaped cavity which is configured to accommodate the lower hooking element.

10. A boat comprising a free stay sail and a furling and adjustment assembly according to claim 1.

* * * * *